US005507429A

United States Patent [19]

Arlin

[11] Patent Number: 5,507,429

[45] Date of Patent: Apr. 16, 1996

[54] TAMPER-EVIDENT SHRINK BAND FOR CONTAINERS

[76] Inventor: Edward M. Arlin, Mountain Ave., Monsey, N.Y. 10952

[21] Appl. No.: 529,590

[22] Filed: Sep. 18, 1995

[51] Int. Cl.[6] ..... B65D 5/43

[52] U.S. Cl. ..... 229/102; 53/399; 53/419; 53/442; 206/807; 229/125.39

[58] Field of Search ..... 229/23 R, 102, 229/118, 125.39, 125.41; 206/497, 807, 459.5; 53/399, 419, 442

[56] References Cited

U.S. PATENT DOCUMENTS

| | | | |
|---|---|---|---|
| Re. 12,968 | 6/1909 | Mitchell . | |
| 1,430,287 | 9/1922 | Crowell . | |
| 1,543,205 | 6/1925 | Crowell . | |
| 1,819,933 | 8/1931 | Watson | 229/102 |
| 2,269,247 | 1/1942 | Borah | 229/23 R |
| 2,721,022 | 10/1955 | Billerbeck | 229/118 |
| 3,067,925 | 12/1962 | Gillam | 229/125.39 |
| 3,088,830 | 5/1963 | Graham | 206/807 |
| 3,286,835 | 11/1966 | Crane, Jr. . | |
| 3,442,735 | 5/1969 | Stensaker | 53/399 |
| 3,466,847 | 9/1969 | Farkas | 53/198 |
| 3,537,635 | 11/1970 | Reas et al. | 229/125.39 |
| 3,918,584 | 11/1975 | Richardson | 206/807 |
| 4,652,473 | 3/1987 | Han | 428/35 |
| 4,655,028 | 4/1987 | Silbernagel | 53/399 |
| 4,944,603 | 7/1990 | Cornish et al. | 383/268 |
| 5,111,953 | 5/1992 | Faust et al. | 220/214 |
| 5,448,876 | 9/1995 | Menayan | 53/399 |
| 5,450,708 | 9/1995 | Lashyro | 53/399 |

FOREIGN PATENT DOCUMENTS

| | | | |
|---|---|---|---|
| 2695913 | 3/1994 | France . | |
| 342162 | 1/1931 | United Kingdom | 229/102 |
| 433189 | 8/1935 | United Kingdom | 229/125.41 |

*Primary Examiner*—Gary E. Elkins
*Attorney, Agent, or Firm*—Perman & Green

[57] ABSTRACT

A system for indicating that a container has been subjected to tampering includes a container having an outer surface with at least one central depressed region defined by opposed upstanding ledges extending sharply transverse to a plane of the depressed region and a continuous band of heat shrinkable material in general alignment with the central depressed region initially loosely encircles the container which, when heated, becomes shortened and congruently conforms to the outer surface of the container and is restrained against lateral movement beyond the upstanding ledges when removal from the container is attempted. The composition and dimensions of the band of heat shrinkable material are selected such that removal from the container cannot be accomplished without causing visibly apparent deformation or fracturing of either the band or of the container. The band of heat shrinkable material may be imprinted with unique indicia or may be formed with perforations to further aid in causing its visibly apparent deformation or fracturing when removal from the container is attempted. The opposed upstanding ledges may be parallel with the continuous band of heat shrinkable material being narrower than the space between the upstanding ledges. The opposed upstanding ledges may be non-parallel and have a width such that it at least partially overlies the upstanding ledges. Heat setting glue may be applied to the interfacing surfaces of the band and container to cause the continuous band of heat shrinkable material to even more firmly adhere to the container.

14 Claims, 2 Drawing Sheets

TAMPER-EVIDENT SHRINK BAND FOR CONTAINERS

BACKGROUND OF THE INVENTION

1. Field of the Invention

The present invention relates to systems which provide an indication that a container has been subjected to improper tampering and, more particularly, to an improved system which utilizes a heat shrinkable band which is drawn into a modified region of the surface of the container.

2. Description of the Prior Art

It is axiomatic that there is no such thing as a tamper-proof container. In truth, the best that can be achieved in this regard is the ability to ascertain readily by means of highly visible expedients where, and approximately when, tampering has occurred.

Various constructions are known for indicating that a container has been subjected to tampering. A heat shrinkable tamper-evident band is disclosed in U.S. Pat. No. 5,111,953 to Faust et al. In this instance, a container lid is placed upon a container in the nature of a bottle or can and heat is applied to a shrinkable strip positioned at the interface of the lower rim of the container lid and the container, thereby creating a tamper evident seal between the lid and the container.

The use of heat shrinkable bands for purposes other than tamper evidency is disclosed in U.S. Pat. Nos. 3,466,847 to Farkas and 3,286,835 to Crane, Jr. In the former instance, the bands are used for creating electrical wire harnesses from multiple individual wires. In the latter instance, a band serves as part of a display package while simultaneously firmly holding the item being displayed.

U.S. Pat. Nos. 4,652,473 to Han and 4,944,603 to Cornish et al. both disclose the use of pressure sensitive adhesive tape capable of providing tamper detection, the former for capped containers, the latter for flexible, bag-like packages.

With respect to closures for boxes, cartons, and the like, U.S. Pat. No. Re. 12,968 to Mitchell discloses the use of an encompassing cord intended to indicate whether tampering has occurred.

The U.S. Pat. Nos. 1,430,287 and 1,543,205 to Crowell both disclose removal of a portion of a corrugated box to aid in the fabrication of a completed box structure.

It was in light of the foregoing state of the art that the present invention has been conceived and is now reduced to practice. Specifically, the invention results from efforts to readily, clearly, and inexpensively provide a tamper-evident system for a variety of container constructions.

SUMMARY OF THE INVENTION

According to the invention, a system is provided for indicating if a sealed container has been subjected to tampering. The system includes a container having an outer surface with at least one central depressed region defined by opposed upstanding ledges extending sharply transverse to a plane of the depressed region and a continuous band of heat shrinkable material in general alignment with the central depressed region which initially loosely encircles the container. When heated, the band of heat shrinkable material becomes shortened and congruently conforms to the outer surface of the container. It is restrained against lateral movement beyond the upstanding ledges when removal from said container is attempted. The composition and dimension of the band of heat shrinkable material is selected such that removal from the container cannot be accomplished without causing visibly apparent deformation or fracturing of either the band or of the container. The band of heat shrinkable material may be imprinted with unique indicia or may be formed with perforations to further aid in causing its visibly apparent deformation or fracturing when removal from the container is attempted. In one embodiment, the opposed upstanding ledges may be parallel while the continuous band of heat shrinkable material is narrower than the space between the upstanding ledges. In another embodiment, the opposed upstanding ledges may be non-parallel and have a width such that it at least partially overlies the upstanding ledges. Also, heat setting glue may be applied to the interfacing surfaces of the band and container to cause the continuous band of heat shrinkable material to even more firmly adhere to the container. In all embodiments, the band prevents access to the contents of the container.

Hence, according to the invention, a shrink band is applied to a corrugated paper or cardboard carton which is the material of choice of today's shipping industry. The carton will have been modified to create a circumference for the shrink band about the middle of the carton which is smaller than the circumference to either side. The band is placed in this "saddle position" and shrunk through the application of heat to its minimum size.

The shrink band may be a shrinkable material, for example, polyvinyl chloride, which shrinks in a preferred direction (normally 40% in the preferred direction and 10% in the other direction which is normal to the preferred direction). The carton may be a die cut box from which some corrugated material has been removed and the band applied and shrunk in this region. One of the properties of the band is to conform to the shape of the surface onto which it is shrunk. By die cutting out a piece of the corrugated paper from the carton, the band cannot be slipped off the ends and the band must be broken in order to enter the carton. This feature can be further improved by die cutting a unique shape into the carton.

For purposes of the invention, the shrink band must exhibit several properties and other requirements. For example, it must be strong enough to withstand above normal shipping and storage environments. This may be achieved by varying the mill thickness and width of the band. Additionally, the shrink band should be easily recognizable at final destination and at time of entry into the carton as not being compromised. Further, the shrink band will be designed so as to break or be clearly recognized to have been tampered with when entry is required. As envisioned, the band must break in order to enter the carton. By reason of the unique design of the invention, the tamper-evident band cannot be readily slipped off the side of carton, then slipped back onto the carton without evidence of tampering.

Printing of the shrink band is recommended. It enhances visibility as well as making it difficult to duplicate and replace. Perforating some portions or all portions of the band also serves to enhance tamper evidency.

In short, the purpose of the invention is to enhance the user's ability to ascertain with some degree of accuracy the time and place of carton compromise in the event, for example, that a customer claims a shortage of product in the carton. The invention might enable a seller to determine whether pilferage occurred during transit or if the customer is lying in his insinuation that product originally in the carton is now missing.

In order to defeat the invention and cover up his pilferage, a thief would need a printed or color coded band or bar coded band identical to that which had been compromised and some means to apply the band, namely, a shrink tunnel or heat gun, both of which require power and may be heavy and bulky. Hence, the invention would be effective in reducing or eliminating the fair weather thief and would add significantly to the time and difficulty faced by the more organized thief.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

Figure 1:
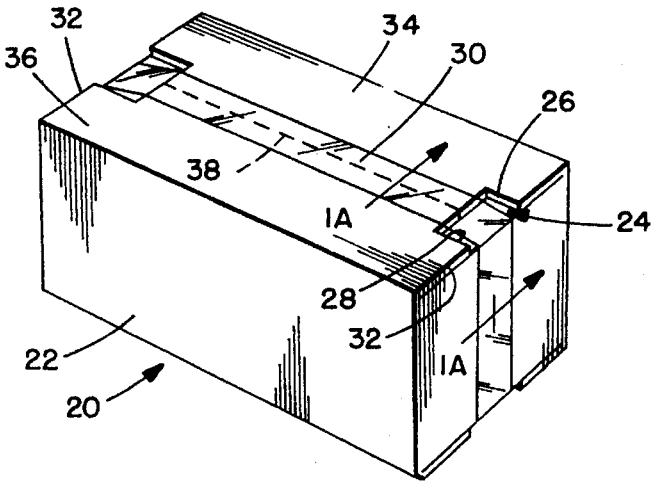
FIG. 1 is a perspective view of a tamper-evident container embodying the present invention.

Turn now to the drawings and, initially, to FIG. 1 which illustrates a sealed container 20 embodying the present invention. The container 20 may be of any suitable material although it would preferably be a corrugated paper or cardboard carton which, as previously noted, is the material of choice of today's shipping industry. Corrugated paper or cardboard cartons are light weight, strong, are protective of their contents, environmentally disposable, and reasonably inexpensive. Nonetheless, although the invention will be described as being applied to such a carton, the scope of the invention is sufficiently broad to encompass containers of all customary shapes and materials.

The container 20 has an outer surface 22 with at least one central depressed region 24 defined by opposed upstanding ledges 26, 28 (see FIGS. 1 and 1A) extending sharply transverse to a plane of the depressed region. A continuous band 30 of heat shrinkable material encircles the container and is in general alignment with the central depressed region 24. Initially, the band 30 loosely encircles the container 20 but, when heated, it becomes shortened and congruently conforms to the outer surface 22 of the container and with the central depressed region 24.

In FIG. 1, the container 20 is illustrated as having a plurality of the depressed regions 24, one adjacent each of a plurality of lateral edges 32 of the container. In the embodiment illustrated in FIGS. 1 and 1A, the opposed upstanding ledges 26, 28 are parallel and the continuous band 30 of heat shrinkable material has a width which is less than the space between the upstanding ledges. The band 30 is restrained against lateral movement beyond the upstanding ledges 26, 28, that is, in either lateral direction when removal of the band from the container is attempted. This is for the reason that the container 20 has been modified from a conventional carton so as to create a circumference for the shrink band 30 about the middle of the carton which is smaller than the circumference to either side. This construction is clearly seen in FIG. 1A and occurs when the band is placed in this "saddle position" and shrunk through the application of heat to its minimum size. Another manner of explaining the foregoing is to say that the band 30 is restrained against sideways movement, that is, movement transverse of the lengthwise axis of the band.

The composition and dimensions of the band 30 of heat shrinkable material are selected such that its removal from the container 20 cannot be accomplished without causing visibly apparent deformation to or fracturing of the band or deformation of the container. To further aid in providing evidence of tampering, the band 30 of heat shrinkable material may be imprinted with unique indicia. These indicia would preferably be of the type which would be periodically altered. For example, the indicia might recite the date, or the color or distinguishing marks might be changed periodically.

In the instance of the construction illustrated in FIG. 1, the container 20 is seen to have a pair of opposed closure flaps 34, 36 whose opposed edges meet at a closure line 38 indicated by a dashed line. The band 30 of heat shrinkable material, therefore, is seen to overlie the closure line 38 and extends longitudinally of the container 20.

Figure 2:
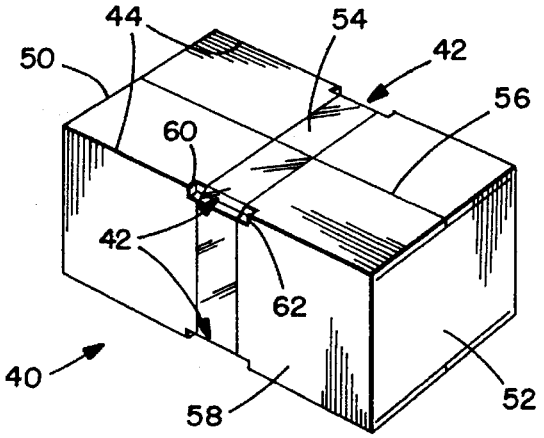
FIG. 2 is a perspective view of another embodiment of a tamper-evident container embodying the present invention.

In FIG. 2, a modified container 40 is generally similar to container 20. However, instead of cutouts in the flaps 34, 36 adjacent a lateral edge 32 to define the central depressed region 24 and the upstanding ledges 26, 28, a modified central depressed region 42 is formed in each hinge line 44 for opposed closure flaps 46, 48 intermediate opposed ends 50, 52 of the container 40. In this instance, a band 54 of heat shrinkable material extends laterally around the container and across a closure line 56 defined by opposed edges of the closure flaps 46, 48.

As with the container 20, the container 40 has an outer surface 58 with at least one central depressed region 42 defined by opposed upstanding ledges 60, 62 extending sharply transverse to a plane of the depressed region. Again, as with the embodiment of FIGS. 1 and 1A, the continuous band 54 of heat shrinkable material encircles the container 40 and is in general alignment with the central depressed region 42. Initially, the band 54 loosely encircles the container 40 but, when heated, it becomes shortened and congruently conforms to the outer surface 58 of the container and with the central depressed region 42. The band 54 is restrained against longitudinal movement beyond the upstanding ledges 60, 62, that is, in either longitudinal direction when removal of the band from the container is attempted. Another manner of explanation is to say that the band 54 is restrained against sideways movement, that is, movement transverse of the lengthwise axis of the band.

Figure 3:
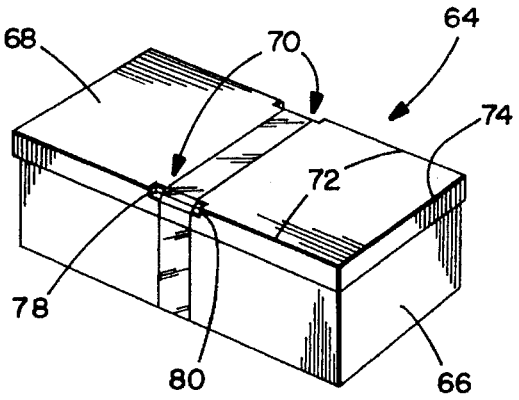
FIG. 3 is a perspective view of still another embodiment of a tamper-evident container embodying the present invention.

In FIG. 3, another modified container 64 is illustrated, constructed generally in the manner of a "shoe box" including a bottom 66 and a top or cover 68 overlying and engaged with an uppermost rim defined by upstanding side walls of the bottom. In this instance, a modified central depressed region 70 is formed in each longitudinally extending fold line 72 for the cover, although it will be understood that similar depressed regions might just as readily be formed in one or both of the laterally extending fold lines for the cover 68. Once again, a band 76 of heat shrinkable material extends laterally around the container, encompassing both the cover 68 and the bottom 66 and, once again, the band 76 is restrained against sideways movement, that is, movement transverse of the lengthwise axis of the band by reason of opposed upstanding ledges 78, 80 extending sharply transverse to a plane of the depressed region 70.

Figure 4:
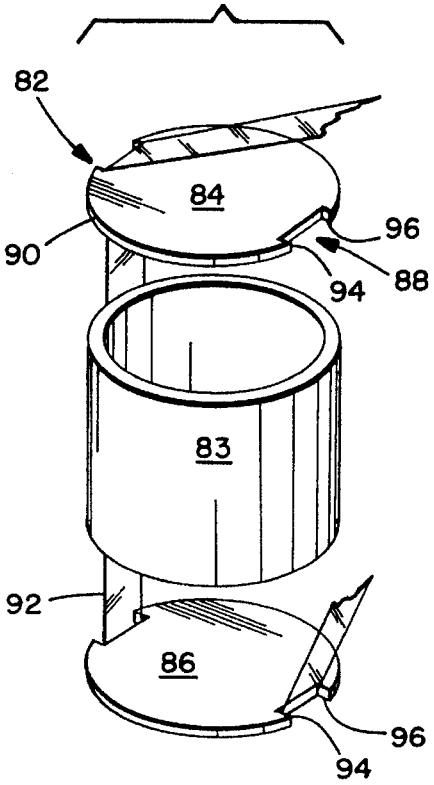
FIG. 4 is a perspective view of yet another embodiment of a tamper-evident container embodying the present invention.

Still another modified container 82 is illustrated in FIG. 4. The container 82 is cylindrical in shape and includes a main body 83 and top and bottom lids 84, 86 which are suitably attachable to the main body in a manner not illustrated. In this instance, modified central depressed regions 88 are formed at diametrically opposite locations in an edge 90 of each of the lids 84, 86. As in the previous embodiments, it will be understood that the invention could be workable with only one depressed region in only one of the lids 84, 86, although it would be preferable to have two and most preferable to have four, as illustrated. In this instance, a band 92 of heat shrinkable material extends lengthwise of the body 83 and diametrically across the lids 84, 86, thereby encompassing the body and both lids. The band 92 is aligned and engaged with each of the depressed regions 88 and is restrained against sideways movement, that is, movement transverse of the lengthwise axis of the band by reason of opposed upstanding ledges 94, 96 extending sharply transverse to a plane of the depressed region 88.

Figure 5:
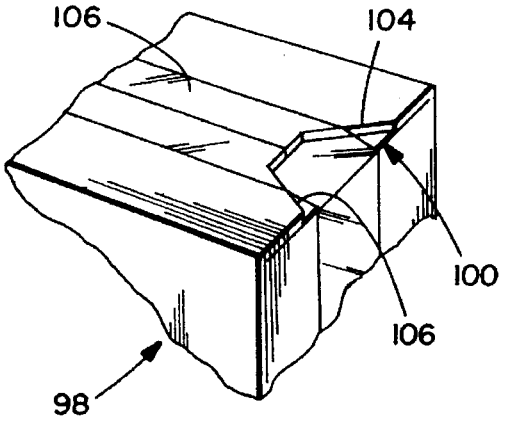
FIG. 5 is a detail perspective view of a further embodiment of a tamper-evident container embodying the present invention.

Turning now to FIG. 5, a modified container 98 is seen to include a modified central depressed region 100 in which opposed upstanding ledges 102, 104 are non-parallel and a continuous band 106 of heat shrinkable material has a width such that it at least partially overlies the upstanding ledges.

Figure 6:
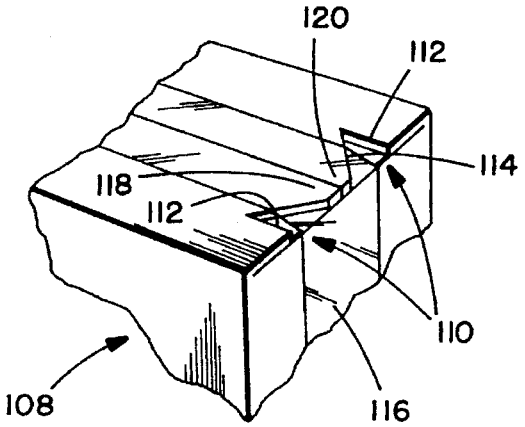
FIG. 6 is a detail perspective view of still a further embodiment of a tamper-evident container embodying the present invention.

Yet another embodiment of the invention is illustrated in FIG. 6 wherein a modified container has a pair of side-by-side central depressed regions 110, possibly mirror images of one another, defined by non-parallel opposed upstanding ledges 112, 114. Perhaps the outermost upstanding ledges 112 would be parallel in this instance. A continuous band 116 of heat shrinkable material has a width narrower than the spacing between the opposed upstanding ledges 112 but such that it overlies lands 118, 120 of the closure flaps of the container which are defined by the upstanding ledges 114.

Figure 1A:
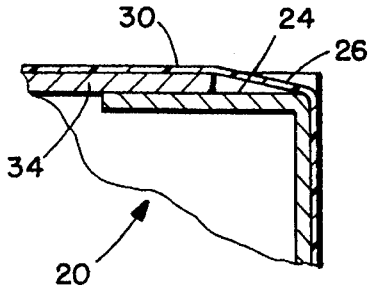
FIG. 1A is a cross section view taken generally along line 1A—1A in FIG. 1.
Figure 7:
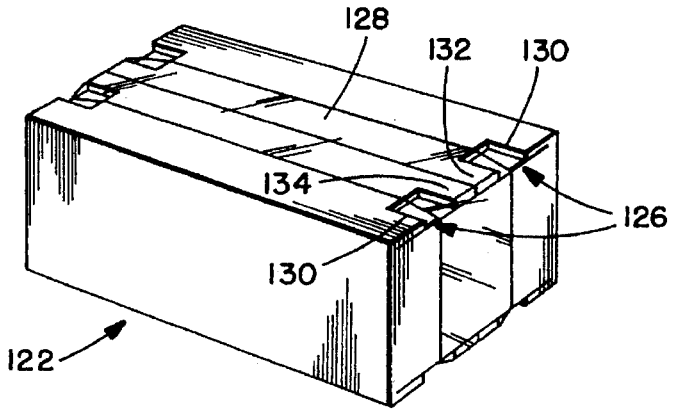
FIG. 7 is a perspective view of yet a further embodiment of a tamper-evident container embodying the present invention.

A further embodiment of the invention is illustrated in FIG. 7 wherein a modified container 122 has a pair of side-by-side central depressed regions 126, each similar to the central depressed region 24 of the embodiment of FIGS. 1 and 1A. A continuous band 128 of heat shrinkable material has a width narrower than the spacing between outermost opposed upstanding ledges 130 but such that it overlies lands 132, 134 of the closure flaps of the container which are defined by the upstanding ledges 114.

Figure 8:
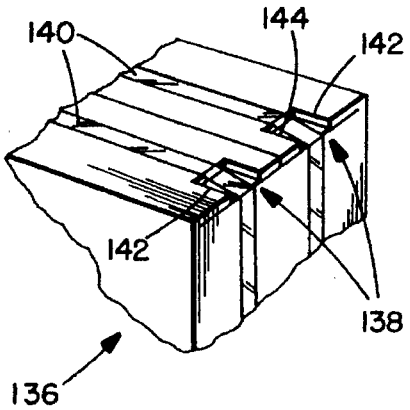
FIG. 8 is an detail perspective view of another embodiment of a tamper-evident container embodying the present invention.

Yet a further embodiment of the invention is illustrated in FIG. 8 wherein a modified container 136 again has a pair of side-by-side central depressed regions 138, each similar to the central depressed region 24 of the embodiment of FIGS. 1 and 1A. A pair of continuous bands 140 of heat shrinkable material are utilized in this instance, each having a width narrower than the spacing between the opposed upstanding ledges 142,144 of each of the depressed regions.

The present invention also includes a variety of other expedients which may be used in various combinations with the different constructions already described. For example, heat setting glue may be applied to the outer surfaces of the band or of the container, including the central depressed region and in general alignment with the location of the continuous band of heat shrinkable material. With the subsequent application of heat, the glue sets and causes the continuous band of heat shrinkable material to even more firmly adhere to the container.

Figure 9:
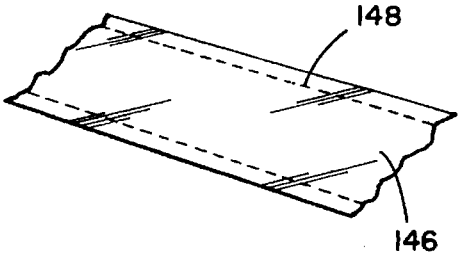
FIG. 9 is a perspective view of a modified component for use with the present invention.

Then, too, viewing FIG. 9, a continuous band 146 of heat shrinkable material, in each instance, may be formed with longitudinally extending perforations 148 to aid in causing visibly apparent deformation to or fracturing of the band of heat shrinkable material when removal from the container is attempted.

To recapitulate the points raised above with respect to the provision of a tamper-evident shrink band for use on various containers, including corrugated paper or cardboard cartons, a 3" to 4" shrink band is suggested (although all widths would be available) and the band would have the following characteristics:

(a) High visibility with use of colors and/or printing.

(b) The need for special equipment to apply a tamper-evident shrink band to containers (for example, by using an on-site heat tunnel) would act as theft deterrent.

(c) The difficulty of opening containers, necessitating breaking the band, would also act as theft deterrent. It is noteworthy that freezing of the band by a thief would be ineffective.

(d) Forming perforations in the band is a desirable expedient which would increase the likelihood of the band breaking upon attempted opening of a container by a thief.

(e) The tamper-evident band is capable of being engineered to varied strength requirements.

The invention may be used internally of an organization to reduce pilferage committed by that organization's own employees. In this regard, the invention is susceptible of:

(1) easy incorporation into present procedures, facilitated by simple hand application and single carton size/single tamper-evident band size; and (2) making available color and printing variations with the capability of tracking with color-coding and printing or use of bar-coded labels and the like.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A method for indicating that a container has been subjected to tampering, said method comprising the steps of:

(a) forming the container having an outer surface with at least one central depressed region defined by opposed upstanding ledges extending transverse to a plane of the depressed region;

(b) loosely encircling the container with a continuous band of heat shrinkable material in general alignment with the central depressed region;

(c) heating the band of heat shrinkable material so that it becomes shortened and congruently conforms to the outer surface of the container and with the central depressed region and is restrained against lateral movement beyond the upstanding ledges when removal from the container is attempted; and (d) selecting the composition and dimensions of the band of heat shrinkable material such that removal from the container cannot be accomplished without causing visibly apparent deformation to or fracturing of the container or of the band of heat shrinkable material.

2. A method as set forth in claim 1 including the step of:

(e) imprinting the band of heat shrinkable material with unique indicia.

3. A method as set forth in claim 1 wherein step (a) includes the step of:

(e) forming the opposed upstanding ledges so as to be spaced apart and parallel; and wherein step (b) includes the step of:

(f) providing the continuous band of heat shrinkable material with a width which is less than the space between the upstanding ledges.

4. A method as set forth in claim 1 wherein step (a) includes the step of:

(e) forming the opposed upstanding ledges so as to be spaced apart and non-parallel; and wherein step (b) includes the step of:

(f) providing the continuous band of heat shrinkable material with a width such that it at least partially overlies and generally conforms to the upstanding ledges after step (c).

5. A method as set forth in claim 1 including the step of:

(e) before step (c), applying heat setting glue selectively to either or both the inner surface of the band or to the outer surface of the container, including the central depressed region, in general alignment with the location of the continuous band of heat shrinkable material to be applied in step (c);

whereby, after step (c), the glue sets and causes the continuous band of heat shrinkable material to even more firmly adhere to the container.

6. A method as set forth in claim 1 wherein step (b) includes the step of:

(e) forming the continuous band of heat shrinkable with longitudinally extending perforations to aid in causing visibly apparent deformation to or fracturing of the band of heat shrinkable material when removal from the container is attempted.

7. A method as set forth in claim 1 wherein said band of heat shrinkable material is polyvinyl chloride.

8. A system for indicating that a container has been subjected to tampering, said system comprising:

a container having an outer surface with at least one central depressed region defined by opposed upstanding ledges extending transverse to a plane of said depressed region; and a continuous band of heat shrinkable material in general alignment with the central depressed region initially loosely encircling the container which, when heated, becomes shortened and congruently conforms to said outer surface of said container and with said central depressed region and is restrained against lateral movement beyond said upstanding ledges when removal from said container is attempted;

the composition and dimensions of said band of heat shrinkable material being selected such that removal from said container cannot be accomplished without causing visibly apparent deformation to or fracturing of said container or of said band of heat shrinkable material.

9. A system as set forth in claim 8 wherein said band of heat shrinkable material is imprinted with unique indicia.

10. A system as set forth in claim 8 wherein said opposed upstanding ledges are spaced apart and parallel; and wherein said continuous band of heat shrinkable material has a width which is less than the space between said upstanding ledges.

11. A system as set forth in claim 8 wherein said opposed upstanding ledges are spaced apart and non-parallel; and wherein said continuous band of heat shrinkable material has a width such that it at least partially overlies said upstanding ledges.

12. A system as set forth in claim 8 wherein heat setting glue is selectively applied to either or both the inner surface of said band or to said outer surface of said container, including said central depressed region, in general alignment with the location of said continuous band of heat shrinkable material:

whereby, after the application of heat, the glue sets and causes said continuous band of heat shrinkable material to even more firmly adhere to said container.

13. A system as set forth in claim 8 wherein said continuous band of heat shrinkable is formed with longitudinally extending perforations to aid in causing visibly apparent deformation to or fracturing of the band of heat shrinkable material when removal from the container is attempted.

14. A system as set forth in claim 8 wherein said band of heat shrinkable material is polyvinyl chloride.

* * * * *